US005333863A

United States Patent [19]

Shenoha et al.

[11] Patent Number: 5,333,863

[45] Date of Patent: Aug. 2, 1994

[54] SYMMETRICAL GOLF PUTTER

[75] Inventors: James L. Shenoha, Lockport; Dean E. Meyer, LaGrange Park, both of Ill.

[73] Assignee: Wilson Sporting Goods Co., Chicago, Ill.

[21] Appl. No.: 55,798

[22] Filed: May 7, 1993

[51] Int. Cl.[5] ..... A63B 53/02

[52] U.S. Cl. ..... 273/80.2; 273/167 G; 273/80 C; 273/169

[58] Field of Search ..... 273/77 R, 167 R, 167 A, 273/167 B, 167 D, 167 F, 167 G, 167 H, 167 J, 168, 169, 171, 172, 173, 174, 78, 164.1, 187.4, 186.2, 80 R, 80 C, 80 A, 80.1, 80.2

[56] References Cited

U.S. PATENT DOCUMENTS

| | | | |
|---|---|---|---|
| 3,758,115 | 9/1973 | Hoglund | 273/167 G X |
| 3,851,877 | 12/1974 | Giambazi | 273/167 F X |
| 4,010,958 | 3/1977 | Long | 273/169 |
| 4,390,184 | 6/1983 | Rudell | 273/164.1 X |
| 4,508,350 | 4/1985 | Duclos | 273/169 X |
| 4,519,612 | 5/1985 | Tsao | 273/167 A X |
| 4,529,202 | 7/1985 | Jacobson | 273/169 X |
| 4,693,478 | 9/1987 | Long | 273/169 X |
| 4,702,477 | 10/1987 | Solomon | 273/169 X |
| 4,852,879 | 8/1989 | Collins | 273/169 X |
| 4,871,174 | 10/1989 | Kobayashi | 273/167 H X |
| 4,898,387 | 2/1990 | Finney | 273/167 F |
| 4,921,253 | 5/1990 | Tesori | 273/167 G X |
| 5,197,737 | 3/1992 | Desbiolles . | |
| 5,226,654 | 7/1993 | Solheim . | |
| 5,255,919 | 10/1993 | Johnson . | |

FOREIGN PATENT DOCUMENTS

| | | | |
|---|---|---|---|
| 2218340 | 11/1989 | United Kingdom | 273/169 |

*Primary Examiner*—Vincent Millin
*Assistant Examiner*—Sebastiano Passaniti

[57] ABSTRACT

A golf putter includes a clubhead and a shaft. The clubhead is symmetrical about a first plane which extends through the center of the clubhead perpendicularly to the face of the clubhead. The centerline of the shaft passes through the intersection between the first plane and a second plane which is perpendicular to the first plane and which extends through the point on the face which is intended to contact a golf ball.

10 Claims, 3 Drawing Sheets

SYMMETRICAL GOLF PUTTER

BACKGROUND

This invention relates to golf putters, and, more particularly, to a putter which resists twisting upon impact with a golf ball.

The function of a putter is to strike a golf ball so that the ball rolls into the hole. It is therefore important that the putter strike the ball so that the ball travels along the intended line of travel.

In most putters the shaft is attached to the head of the putter at or near the heel end of the head. The center of percussion or sweetspot of the head is at or near the center of the head. If the ball is not struck by the sweetspot of the head, the head tends to twist at impact which will cause the ball to roll off line.

In some putters the shaft is attached to the head at or near the midplane of the head, i.e., the plane which extends through the center of the head perpendicularly to the face of the head. However, such putters still have a tendency to tiwst at impact if the ball is not struck by the sweetspot.

SUMMARY OF THE INVENTION

The invention provides a putter having a balanced or symmetrical head and a shaft which intersects the plane of symmetry where that plane intersects a second plane which is perpendicular to the plane of symmetry and which passes through the point of the face which is intended to contact a golf ball. The clubhead is thereby provided with increased resistance to twisting upon impact with a golf ball, particularly when the ball is not impacted at the plane of symmetry.

DESCRIPTION OF THE DRAWING

The drawing will be explained in conjunction with illustrative embodiments shown in the accompanying drawings, in which.

DESCRIPTION OF SPECIFIC EMBODIMENTS

Figures 1, 1A, 2, 3:
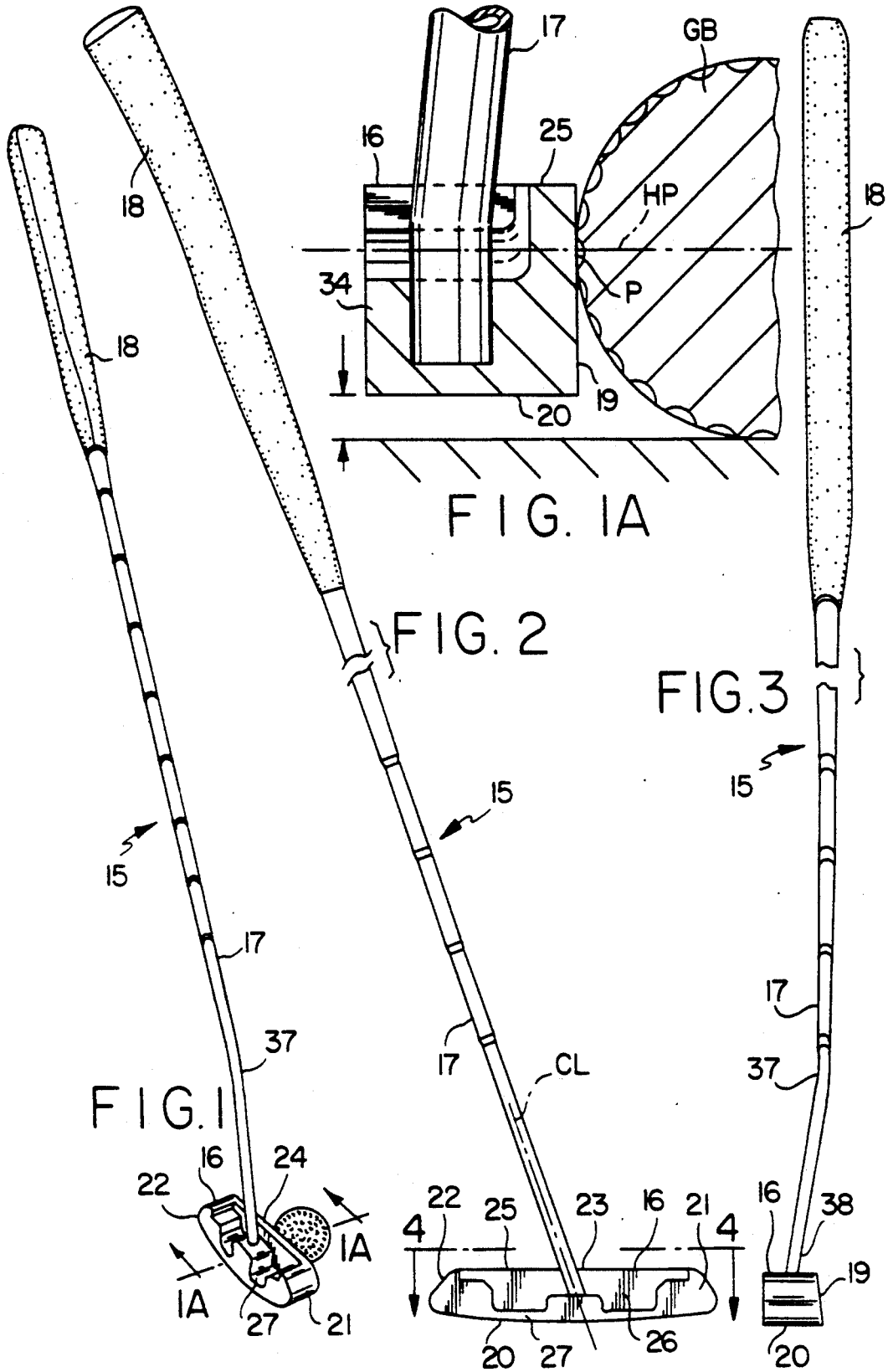
FIG. 1 is a perspective view of a golf putter formed in accordance with the invention.
FIG. 1A is an enlarged fragmentary sectional view taken along the line 1A—1A of FIG. 1.
FIG. 2 is a rear elevational view, partially broken away, of the putter.
FIG. 3 is a toe end view partially broken away, of the putter.
Figure 4:
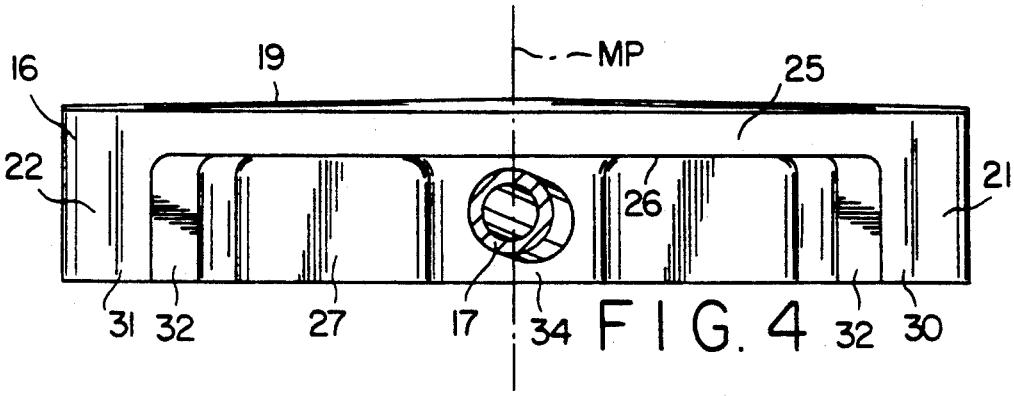
FIG. 4 is a top plan view of the putter head taken along the line 4—4 of FIG. 2.
Figure 5:
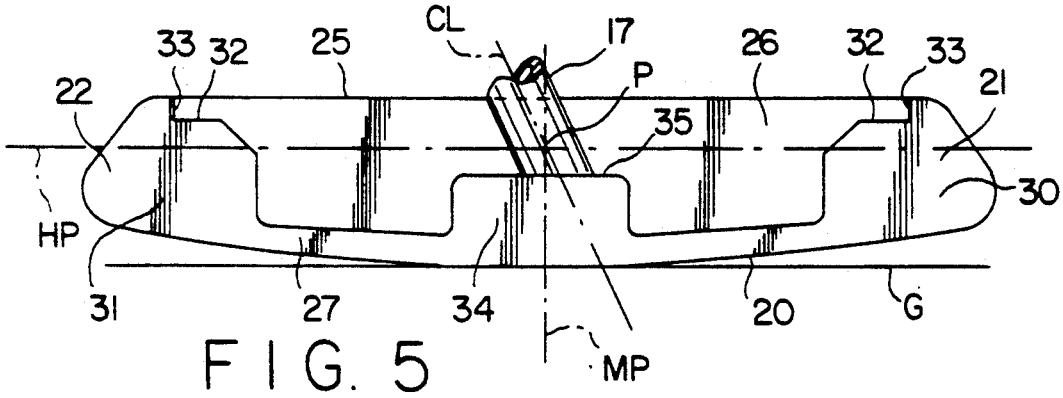
FIG. 5 is a rear elevational view of the putter head.

FIGS. 1-5 illustrate a putter 15 which includes a clubhead 16 and a shaft 17. A grip 18 covers the upper end of the shaft.

The clubhead includes a flat front face 19, a sole 20, a toe portion 21, a heel portion 22, and a central portion 23 between the toe and heel portions. The face is provided by a plate-like face portion 24 which has a flat top edge 25 and a flat back surface 26. The top edge 25 extends parallel to a ground plane G (FIG. 5) which is tangent to the center of the sole when the clubhead is soled and assumes the correct lie angle. A flange portion 27 extends rearwardly from the face portion, and the bottom surface of the flange portion provides the sole 20.

The toe portion 21 includes a toe weight 30 which extends upwardly from the flange portion and rearwardly from the face portion, and the heel portion 22 includes a similar heel weight 31. In the embodiment illustrated in FIGS. 1-5 each of the toe and heel weights include a flat top surface 32 which is parallel to and below the top edge 25 and an upwardly extending surface 33. The central portion 23 of the clubhead includes a projection or lug 34 which includes a flat top surface 35 which is spaced below the top surfaces 32 of the toe and heel weights.

The clubhead is symmetrical about a midplane MP which extends through the center of the clubhead equidistant from the toe and heel ends and which is perpendicular to the face 19 and the ground plane G. The toe and heel portions are mirror images about the midplane. The clubhead is preferably formed integrally of a homogeneous material, and the weight of each half of the clubhead on either side of the midplane is the same. Metal clubheads may be formed by conventional casting, forging, or machining techniques.

The shaft 17 is inserted into a bore which is formed in the central projection 34. The centerline CL of the shaft when viewed from the front or back lies in a plane which is perpendicular to the face 19. The shaft is positioned relative to the clubhead so that the centerline of the shaft passes through the intersection between the midplane MP and a horizontal plane HP (FIG. 1A) which is perpendicular to the midplane and parallel to the ground plane and which extends through the point P on the face which is intended to contact a golf ball GB. The horizontal plane is parallel to the ground plane G and the top edge 25. In the embodiment illustrated in FIGS. 1-5, the top surface 35 of the central projection 34 is below the plane HP, and the shaft enters the central projection at a location which is spaced away from the midplane MP toward the toe 21 of the clubhead (see FIG. 5).

Referring to FIG. 1A, the outside diameter of a conventional golf ball is 1.68 inch. Since the sole of the putter will generally be slightly above the ground G when the putter strikes the ball, the distance from the sole to point P on the face of the putter which contacts the golf ball will usually be somewhat less than 0.84 inch, which is half of the ball diameter. Assuming that most golfers hold the putter about 0.215 inch above the ground at impact, in one embodiment of the putter the shaft was positioned so that its centerline CL intersected the midplane MP 0.625 inch above the point where the midplane intersected the sole. Since different golfers may hold the putter different distances above the ground at impact, the intended point of impact P can vary from about 0.50 inch to 0.84 inch above the sole. The centerline of the shaft can therefore intersect the midplane from about 0.50 to 0.84 inch above the sole. However, spacing of about 0.625 (within normal manufacturing tolerances for putters) is preferred.

The shaft 17 in FIGS. 1-5 is offset when viewed from the toe or heel end (FIG. 3). The centerline of the upper end of the shaft lies in a plane which is substantially parallel to the face 19, and the shaft angles rearwardly at a first offset point 37 and angles downwardly at a second offset point 38. However, the shaft appears straight when viewed from the front or back of the putter (FIG. 2).

In the embodiment illustrated in FIGS. 1-5, the face 19 of the putter is provided with a loft angle of $3.0 \pm 1.5$ degrees. However, greater or less loft, or no loft, can be used as desired.

Figure 6:
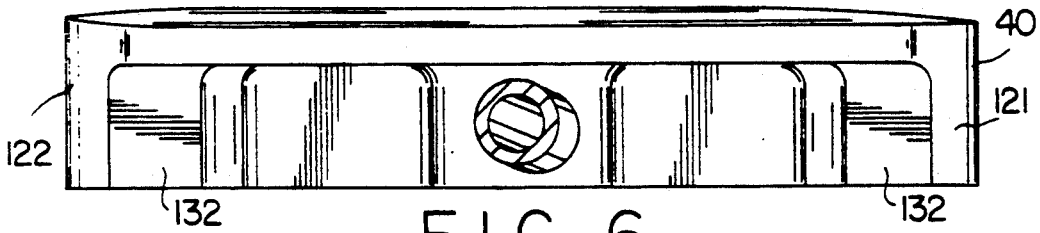
FIG. 6 is a view similar to FIG. 4 of another embodiment of a putter head.
Figure 7:
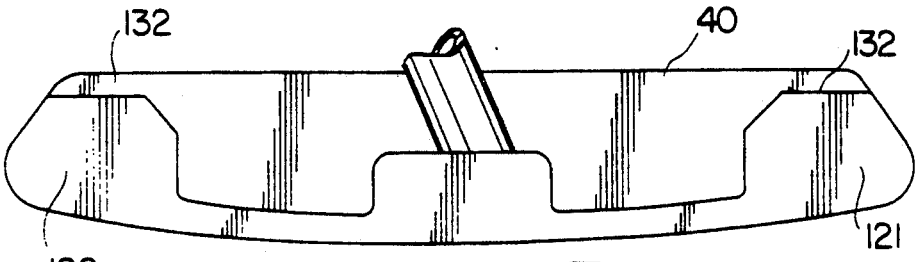
FIG. 7 is a rear elevational view of the putter head of FIG. 6.

FIGS. 6 and 7 illustrated a modified putter head 40 which is substantially the same as the putter head 16 except that the top surfaces 132 of the toe and heel portions 121 and 122 extend all the way to the outer surfaces of the toe and heel.

Figure 8:
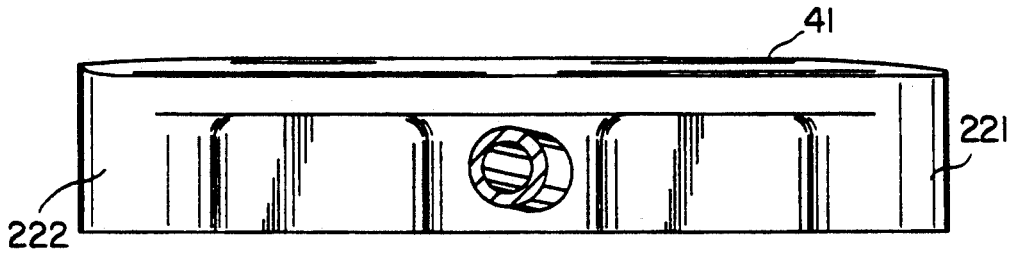
FIG. 8 is a view similar to FIG. 4 of still another embodiment of a putter head.
Figure 9:
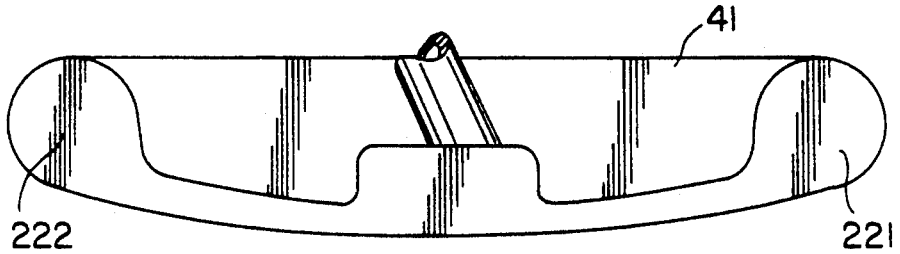
FIG. 9 is a rear elevational view of the putter head of FIG. 8.

In FIGS. 8 and 9 a putter head 41 is similar to the putter head 16 except that the top surfaces of the toe and heel portions 221 and 222 are rounded.

Figure 10:
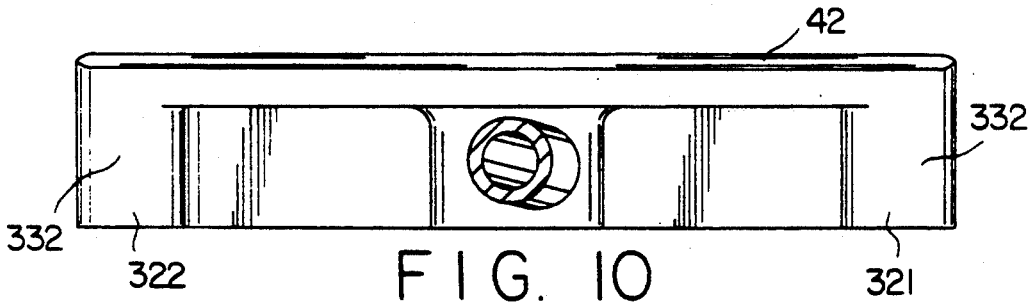
FIG. 10 is a view similar to FIG. 4 of yet another embodiment of a putter head.
Figure 11:
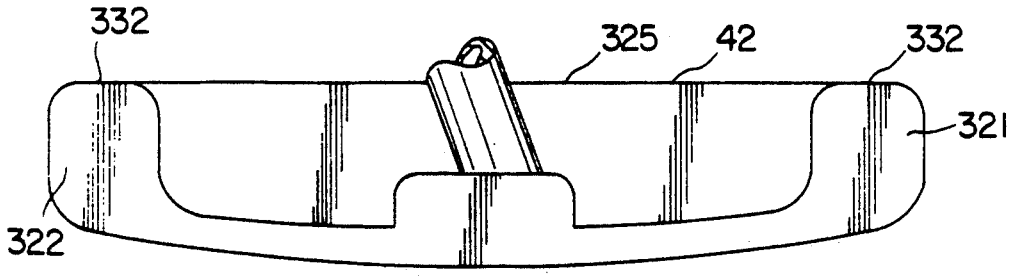
FIG. 11 is a rear elevational view of the putter head of FIG. 10.

In FIGS. 10 and 11 a putter head 42 includes toe and heel portions 321 and 322 which include top surfaces 332 which lie in the same plane as top edge 325 and vertical inside surfaces 43 and 44.

In all of the embodiments the putter head is symmetrical about a midplane, and the centerline of the shaft passes through the intersection of the midplane and a horizontal plane which extends through the intended point of impact with the ball.

While in the foregoing specification a detailed description of specific embodiments of the invention were set forth for the purpose of illustration, it will be understood that many of the details herein given may be varied considerably by those skilled in the art without departing from the spirit and scope of the invention.

We claim:

1. A golf putter comprising a clubhead and a shaft attached to the clubhead, the clubhead having a face portion which includes a flat face for striking a golf ball and top and bottom edges, a sole, a toe portion, a heel portion, a central flange portion between the toe and heal portions which extends rearwardly from the bottom edge of the face portion, the flange having a top surface which is spaced below the top edge of the face portion, the weight of the clubhead being distributed substantially symmetrically on both sides of a first plane which extends through the center of the clubhead perpendicularly to the face, the shaft having a centerline which passes through the intersection between said first plane and a second plane which is perpendicular to said first plane and which extends through the point on the face which is intended to contact the golf ball, the shaft being attached to the flange portion rearwardly of the face portion and below the top edge of the face portion.

2. The putter of claim 1 in which said second plane is spaced from about 0.50 to about 0.84 inch above the point of the sole which is intersected by said first plane.

3. The putter of claim 1 in which the shaft includes a bottom end which is attached to the clubhead and a top end, the centerline of the shaft between the bottom and top ends lying in a plane which passes through said intersection between said first and second planes.

4. The putter of claim 1 in which the clubhead is integrally formed of homogeneous material.

5. The putter of claim 1 in which the portions of the clubhead on opposite sides of said first plane are mirror images.

6. The putter of claim 1 in which the portion of the sole which is intersected by said first plane is tangent to a ground plane which is parallel to said second plane.

7. The putter of claim 1 in which the top surface of the flange is spaced below said second plane and the shaft is attached to the flange portion below said second plane.

8. The putter of claim 1 in which the toe portion includes a toe weight which extends upwardly from the flange and the heel portion includes a heel weight which extends upwardly from the flange.

9. The putter of claim 8 in which the flange portion includes an upwardly extending lug portion in the central portion of the clubhead, the lug portion having a top surface which is spaced below the top edge of the face portion and a bore in which the shaft is inserted.

10. The putter of claim 9 in which the top surface of the lug portion is below said second plane.

* * * * *